United States Patent [19]

Phillips

[11] Patent Number: 4,850,916

[45] Date of Patent: Jul. 25, 1989

[54] SAILBOARD STEERING ARRANGEMENT

[76] Inventor: Laurent M. Phillips, 2 Main Road, Wynberg 7800, South Africa

[21] Appl. No.: 21,679

[22] Filed: Mar. 4, 1987

[30] Foreign Application Priority Data

Mar. 5, 1986 [ZA] South Africa ..... 86/1621

[51] Int. Cl.[4] ..... B63H 25/02

[52] U.S. Cl. ..... 441/74; 114/153

[58] Field of Search ..... 114/144 R, 152, 153, 114/162, 163, 39.2, 127, 128; 441/65–68, 74, 75

[56] References Cited

U.S. PATENT DOCUMENTS

| | | | |
|---|---|---|---|
| 166,839 | 8/1975 | Ascough | 114/153 |
| 231,017 | 8/1980 | Davis | 114/153 |
| 253,226 | 2/1982 | Rees | 114/163 |
| 2,654,335 | 10/1953 | Ball | 114/153 |
| 2,726,622 | 12/1955 | Daniels | 114/153 |
| 3,844,243 | 10/1974 | Catoni | 114/153 |
| 4,561,370 | 12/1985 | Sanford | 114/163 |
| 4,722,706 | 2/1988 | Young | 114/153 |
| 4,728,307 | 3/1985 | Burgess | 114/153 |
| 4,702,713 | 6/1987 | Lee | 114/153 |

FOREIGN PATENT DOCUMENTS

| | | | |
|---|---|---|---|
| 650922 | 10/1937 | Fed. Rep. of Germany | 114/153 |
| 194765 | 5/1955 | Fed. Rep. of Germany | 114/153 |

*Primary Examiner*—Joseph F. Peters, Jr.
*Assistant Examiner*—Clifford T. Bartz
*Attorney, Agent, or Firm*—Larson and Taylor

[57] ABSTRACT

A sailboard arrangement includes a board having a tail end and a forward end and a deck face and a bottom face. A steering arrangement including a foot control member pivotally mounted to the board. It has a foot engagement formation above the deck face of the board; pivotation means provided at the tail end of the board; mounting means for mounting a rudder to the pivotation means; and connection means for connecting the foot control member to the pivotation means. By operating the foot control member the angular position of the rudder relative to the board can be varied.

3 Claims, 5 Drawing Sheets

FIG. 2
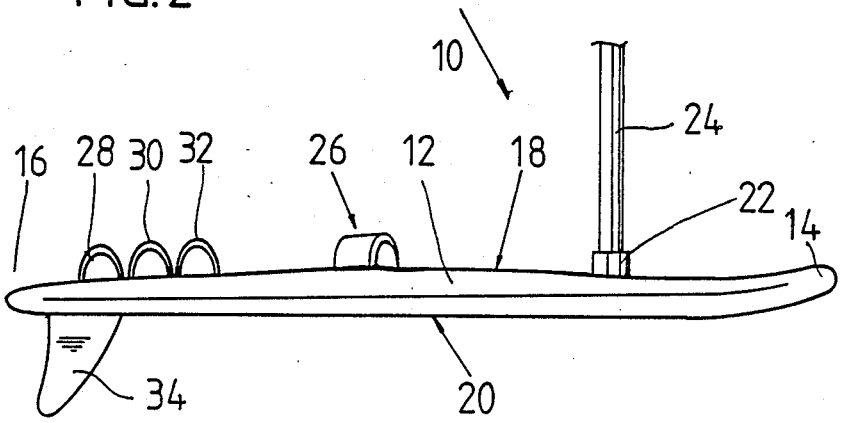
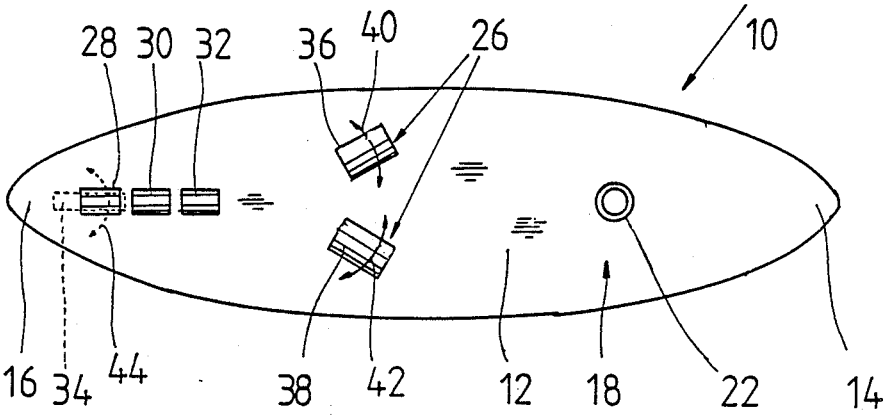
FIG. 3

SAILBOARD STEERING ARRANGEMENT

FIELD OF THE INVENTION

The present invention relates to steering arrangements.

More particularly, the invention relates to steering arrangements for waterborne boards, such as sailboards.

BACKGROUND TO INVENTION

Conventional sailboards include a board with an upper or deck face or surface on which a number of foot locating stirrups or straps are provided and which has a support base for supporting the rig. On the bottom or water side of the board a fixed rudder or fin is provided.

The two hydraulic forces employed to turn a sailboard are firstly, tilting the rig to move the centre of effort of the sail to provide a turning moment in the required direction. Secondly, if the board has reasonable speed, digging a rail will increase the velocity of water flow on one side of the board inducing a lower pressure and a turning force.

When tacking or gybeing any sail powered craft, it is desirable to get the craft on the next tack with sail set as quickly as possible in order to:

a. Minimise the loss of "windage".

b. Minimise the time taken to turn.

c. To avoid the lack of control when sailing very close to the wind.

Most sail powered craft use a rudder, which deflects the water flowing past it and by Newton's second law of action and reaction, a powerful hydraulic force is employed to turn the craft. The problem with a sailboard is that with both hands on the boom, to suggest a hand held tiller is impractical.

A sailboard is used in many different conditions from smooth lake to rough sea, so an effective rudder must be controllable at speed and when the board is bouncing over choppy waves.

The vast majority of boardsailors and hence board purchasers are reasonably affluent, sail perhaps once a week for 20 weeks in a year on large (3 to 4 meter) boards on flat water. Most sailors cannot waterstart and are probably not very fit. So a sailing session is limited by the number of times they fall off and subsequently have to uphaul the sail. Most falls occur during the turn (a board with a low volume tail will perform well, but when slowed half way through a poor gybe becomes very unstable and likely to put the sailor into the water). It follows that an innovation that makes turning easier, faster and more successful can be developed can assist in overcoming the disadvantage inherent in conventional sailboards.

It is an object of the invention to suggest steering means for such rudders and also to a board including such steering means.

SUMMARY OF INVENTION

According to the invention a sailboard with steering arrangement includes (a) a board having a longitudinal center line and a tail end, a forward end, two longitudinal sides; an upper deck face and a bottom face;

(b) at least one pair of foot control members;

(c) support means for pivotally supporting each foot control member to the board so that each foot control member of each pair is offset from the board's center line and is pivotable about a substantially vertical pivotation axis;

(d) a foot engagement formation for each foot control member above the deck face of the board;

(e) pivotation means provided at the tail end of the board;

(f) mounting means including a mounting plate for mounting a rudder to the pivotation means;

(g) connection means for operatively connecting each foot control member to the pivotation means for controlling the angular position of the rudder relative to the board by pivotation of any one of the foot control members about its vertical pivotation axis; and (h) a sail mast support for supporting a sail mast extending from the upper deck face.

Each foot control formation may include at least one strap adapted for receiving the foot of a person standing on the board.

The sailboard may include biasing means for biasing the rudder into a neutral position, being in alignment with the longitudinal center line of the board.

BRIEF DESCRIPTION OF DRAWINGS

The invention will now be described by way of example with reference to the accompanying schematic drawings.

In the drawings there is shown in

FIG. 2 a side view of the board seen along arrow II in FIG. 1;

FIG. 3 a plan view corresponding to FIG. 1 but not showing any details of the steering arrangement;

DETAILED DESCRIPTION OF DRAWINGS

Figure 1:
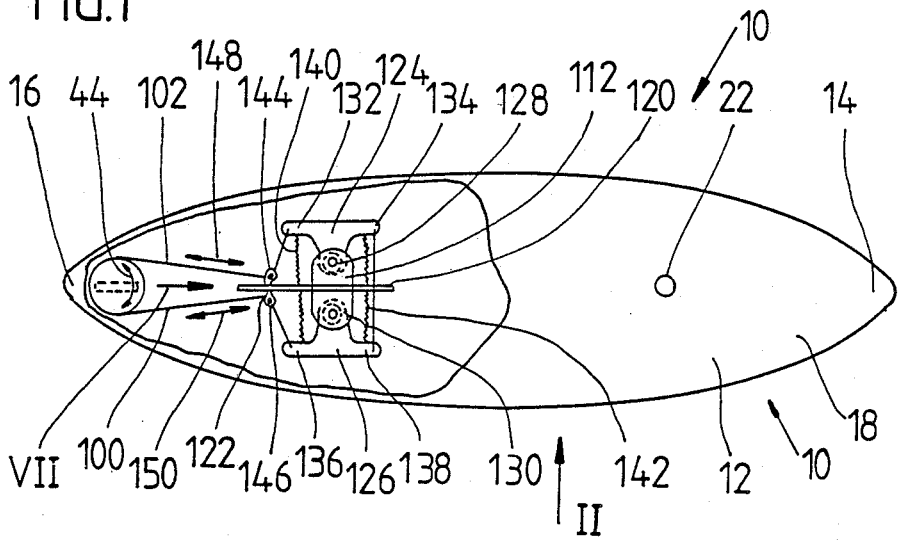
FIG. 1 a plan view of a first embodiment of a sailboard provided with a steering arrangement in accordance with the invention and being partially cut open on the deck side to show some details of the steering arrangement.

Referring to FIGS. 1 to 3, the sailboard, generally indicated by reference numeral 10, includes a board 12 having a nose or forward end 14 and a rear or tail end 16. The board has an upper or deck face 18 and a bottom or water face 20.

On the upper face 18 support means 22 for a sail mast 24 is provided.

Furthermore, on the deck face 18 a pair of foot control stirrups or straps 26 are located as well as a number of rear fixedly located foot support stirrups or straps 28, 30, 32.

On the bottom of the board 12, namely extending from the bottom face 20, a rudder 34 is located.

The foot control stirrups 26 are connected by means of connection means, which will be described hereinafter, so as to be able to control the pivotation of the rudder 34 about a vertical axis.

The steering mechanism in accordance with the invention, includes the foot control stirrups or straps 26 and their associated operative parts, the rudder 34 and its associated operative parts, and the connection parts operatively connecting the foot control stirrups 26 to the rudder 34.

As is shown in FIG. 3 the foot control 26 includes two coupled foot stirrups or straps 36, 38, which are adapted to be rotatable about a vertical axis so as to be pivotatable in the directions indicated by reference numeral 40, 42 respectively. By suitable pivotation of the stirrup 36 or 38 the rudder 34 can be pivoted about a vertical axis as indicated by reference numeral 44.

In use, the arrangement will be used as follows:

TACKING

In a strong wind, the sailor will have his front foot in one of the foot controls 36 or 38. A clockwise pivotation of one of the foot controls 36, 38 will result in a corresponding pivotation of the rudder 34. The board 12 will head up into the wind and as the nose 14 of the board 12 approaches the wind, the front foot is moved around the mast base 22 to the opposite side of the board 12. If necessary, the rear foot of the sailor can be used to twist the front control speeding up the tack. The turn is completed by assuming sailing position on opposite tack.

GYBEING

As for a conventional sailboard, to initiate the gybe, the rear foot of the sailor is placed on the leeward rail near to the front in the foot control 36 or 38. An anticlockwise pivotation of the foot control 36 or 38 will give a corresponding pivotation of the rudder 34. Once the tail 16 of the board 12 has passed through the wind, the rig is flipped onto the new side, the foot is removed from the foot control 36, 38, the rudder 34 self centres itself (as described hereafter) and the correct sailing position can be assumed on the next tack. The foot control 36 or 38 pivotates in the opposite sense to the pivotation of the board 12, this facilitates easy removal of the foot from the strap of the foot controls 36 or 38 when assuming the sailing position on the next tack. It also reduces the risk of injury to the sailor by not placing the foot, ankle or leg at an unnatural angle.

Figure 5:
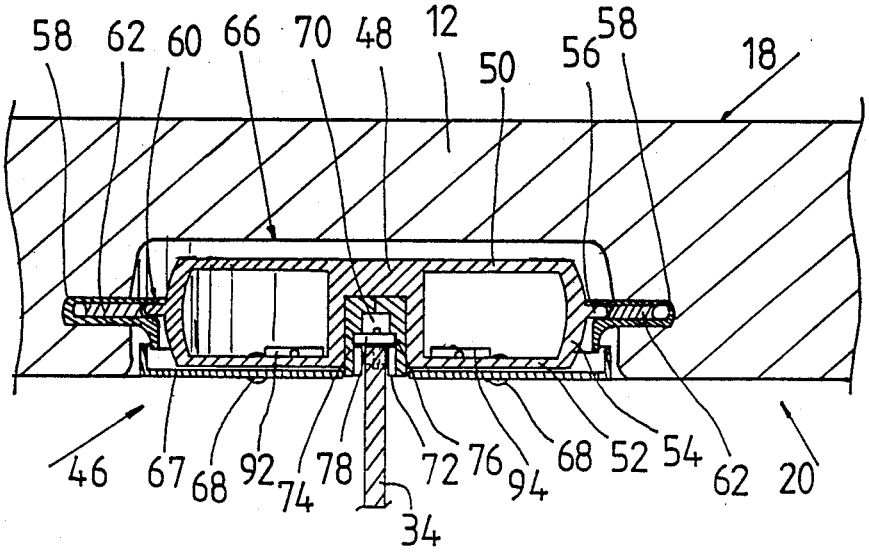
FIG. 5 a sectional side view seen along arrow V—V in FIG. 4.
Figure 4:
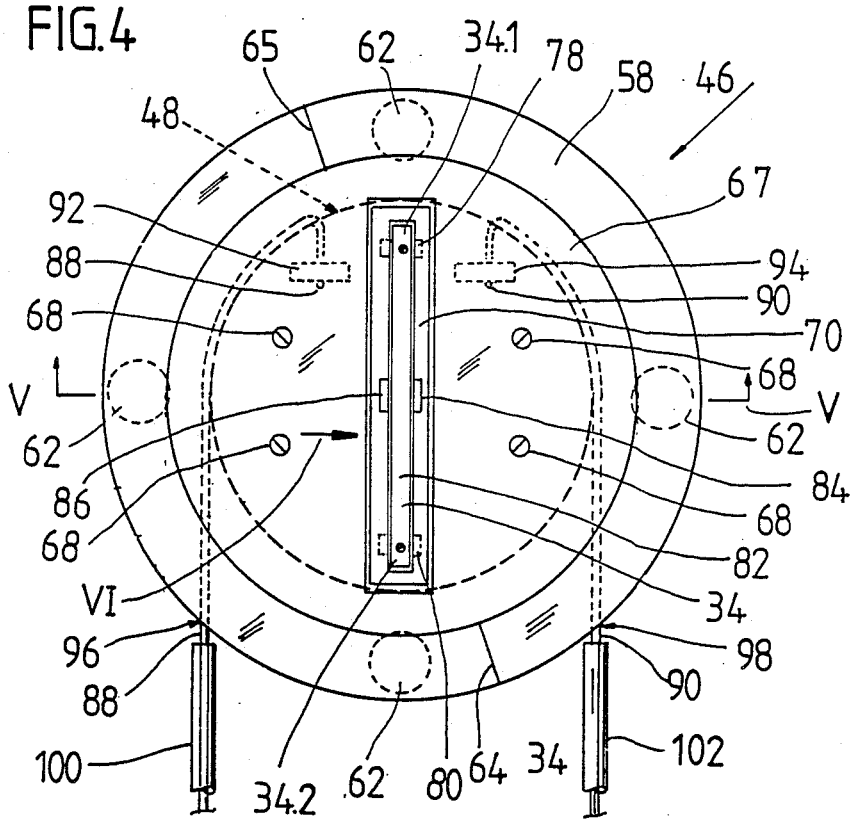
FIG. 4 on a larger scale, a view from below on the rudder control mechanism of the steering arrangement in accordance with the invention.

Referring now to FIGS. 4 and 5, the rudder steering mechanism 46 includes a rotatable rudder box 48 having an upper wall 50, a lower wall 52 and an annular wall 54. A circumferential bearing flange 56 extends outwardly from the annular wall 54. The flange 56 engages into a groove or recess provided in a ring-shaped bearing ring 58, which in cross-section is C-shaped with the open end 60 facing inwardly. The bearing ring 58 includes a number of rotatable wheels 62 for rotatably locating the rudder body 48 by engaging with the circumferential face of the flange 56. The bearing ring 58 is constructed in split form, and is split along the lines 64, 65, so that it can be fitted around the flange 56 before being embedded in a sailboard 12 as shown in FIG. 5.

The flange 56 and the wheels 62 are made to a close tolerance and are lubricated so as to reduce play.

The bearing ring 58 is embedded in the board 12 during the manufacture thereof so that the rudder box 48 is located in a recess 66 in the board 12.

At the bottom a cover plate 67 is fitted to cover the box 48 to the outside. It is screw-connected by means of screws 68 to the box wall 52.

Figure 6:
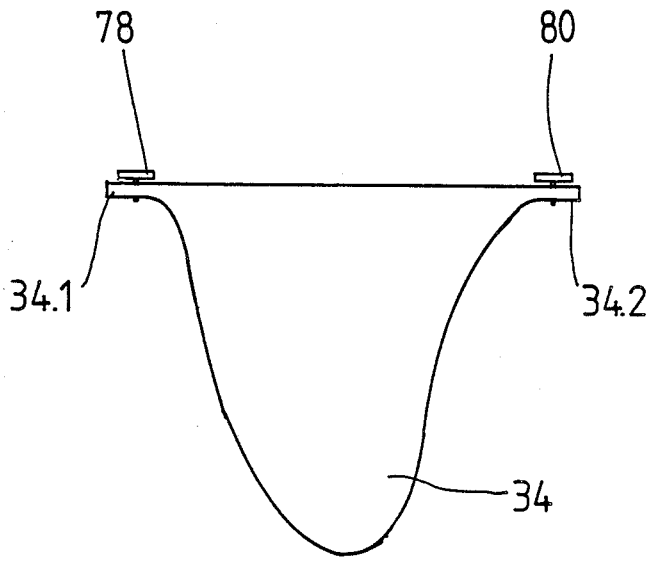
FIG. 6 a side view of the rudder only seen along arrow VI in FIG. 4 and showing its connection to the support plates.

In the box 48 a central elongated recess for receiving a locating channel 70 with a bottom opening 72 is provided. In the side walls of the channel 72 grooves 74, 76 are provided. These grooves 74, 76 slidingly receive plates 78, 80 which are in turn attached to the rudder 34 (see FIG. 6). In the centre the guide 70 has sidewardly projecting gaps 84, 86 where the plates 78, 80 can be inserted into prior to being moved into the respective opposite positions as shown. When in the correct positions, the rudder 34 is screw-connected at its ends 34.1, 34.2 to the plates 78, 80 as shown in FIG. 6.

Cables 88, 90 are connected by means of clamps 92, 94 to the box 48 and extend on the outside of the box 48 through openings 96, 98 from where they are guided in tubes 100, 102 to the foot control mechanism as will be described hereinafter.

The control cables 88, 90 pull at the outer radius of the box 48 giving maximum stability. The cables 88, 90 are anchored at the rear of the box 48 in the clamps 92, 94. These clamps 92, 94 are accessable after the board 12 is assembled by removing the cover 67 so that adjustments to the neutral line of the rudder 34 and cable tension can be made easily. By clamping the cables 88, 90 at the rear of the box 98, the box 48 can rotate 60° or more whilst maintaining a constant lever arm. (A maximum rotation of 35°–40° either side of neutral is preferable).

The cover plate 67 helps to reduce the penetration of dirt, sand, etc. A lubricant between the box flange 56 and the bearing ring 58 reduces water penetration to a minimum and eliminates particles of sand, etc. from getting into the bearing ring 58. The control cables 88, 90 run through close fitting sleeves 100, 102 which prevents water from getting into the control bay.

Figure 7:
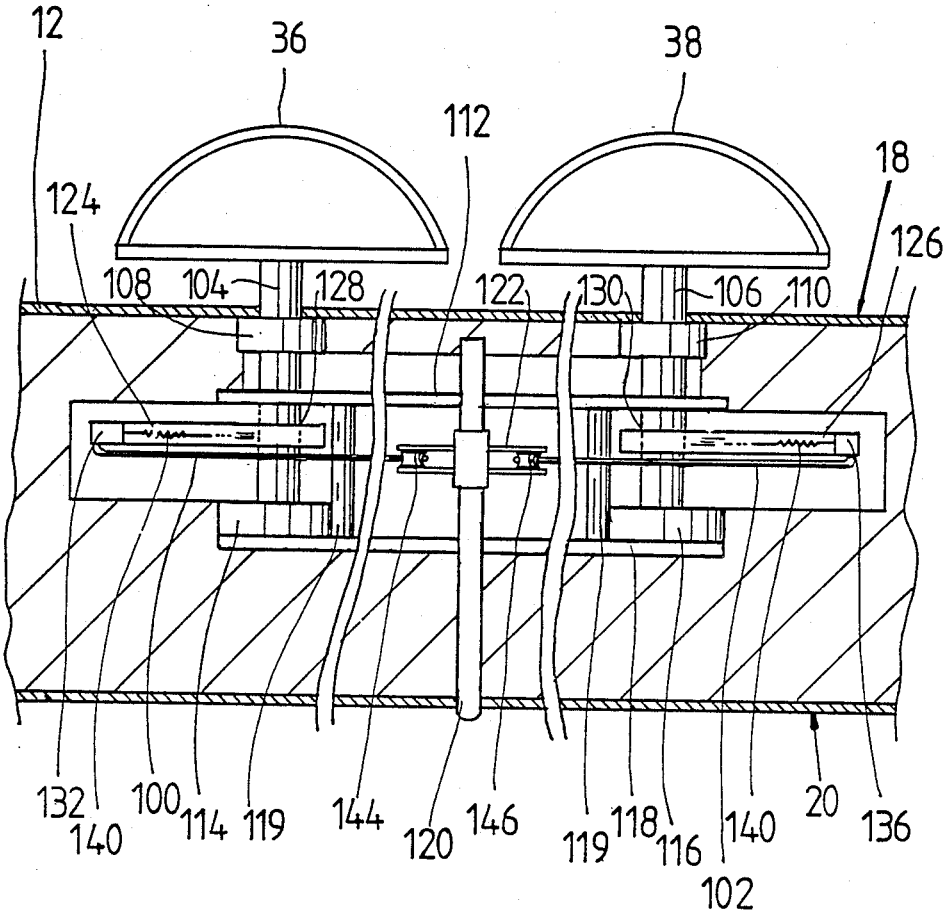
FIG. 7 also on a larger scale, a sectional front view of the foot control arrangement of the steering arrangement in accordance with the invention and seen along arrow VII in FIG. 1.

Referring now to FIGS. 1 and 7, the foot control stirrups or straps 36, 38 are respectively mounted on shafts 104, 106, which are located by means of bearings or bushes or seals 108, 110 in the board 12. The shafts 104, 106 extend through a plate 112 and are located by means of bottom bearings 114, 116 respectively on a bottom plate 118. The plates 112 and 118 are held together by bolts 119. A centre strengthening rib or keel 120 extends in the middle of the board 12 and supports a centre support 122. (Also refer to FIG. 1). Two pivotal levers 124 and 126 are respectively connected at 128 and 130 to the shafts 104, 106. The levers 124 and 126 have outer arms 132, 134 and 136, 138 respectively. These outer arms are joined by means of springs 140, 142 so that the arms 132, 134 and 136, 138 are substantially parallel in normal position. The cables 100, 102 extend over pulleys 144, 146 to be joined to the arms 136, 132 respectively.

By pivoting either foot control stirrup 36 or 38, the other foot control 38 or 36 will automatically be pivoted together therewith. Therefore by pivoting either foot control stirrup 36 or 38 in the direction indicated by arrow 40 or 42, the cables 100 and 102 will be moved in the directions indicated by arrows 148, 150 so as to cause a pivotational movement of the box 48 in the direction indicated by arrow 44 and thus also of the rudder 34. Therefore by means of the foot controls 36 or 38 the rudder 34 can be pivoted for steering the board 12 as may be required.

Figure 8:
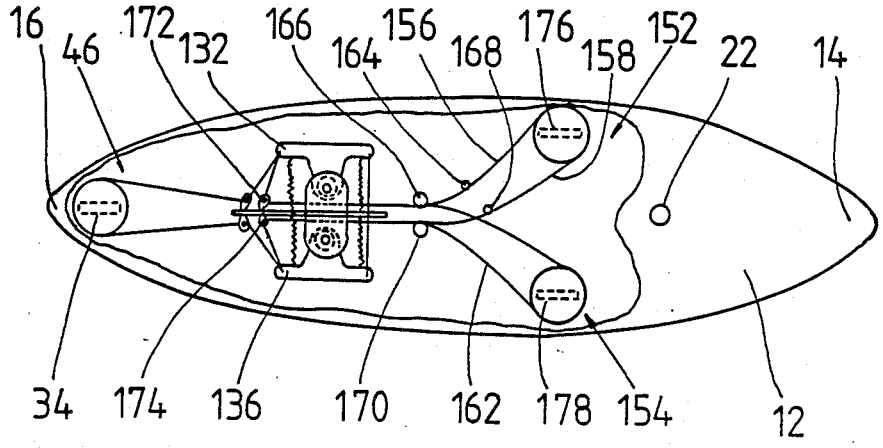
FIG. 8 a plan view of a second embodiment of a sailboard provided with a steering arrangement in accordance with the invention, and being partially cut open on the deck side to show some details of the steering arrangement.

In the embodiment shown in FIG. 8 the same reference numerals are used as in the other drawings. However, in this case additional rudder mechanisms 152, 154 are provided. They are identical to the rudder mechanism 46 (except that the rudders are smaller than the rudder 34) and have cables 156, 158 and 160, 162 joined via pulleys 164, 166, 168, 170 and pulleys 172 and 174 to the arms 136 and 132. Thus by operation of the foot controls 36, 38 the rudders 176 and 178 will be pivoted in association with the rudder 34 at the back.

The shafts 104, 106 may be made of aluminium.

The foot controls may include an upper (preferably double) strap made of rubber or other slightly flexible or padded material and being connected to a foot plate of laminated fibreglass with a central steel plate embedded in it.

The return strip 140, 142 must be sufficiently strong to ensure a return of the levers 124, 126 to their normal positions when the foot pivotation force is released.

The bearings 108, 110 may also be replaced by a silicon seal.

I claim:

1. A sailboard steering arrangement which includes:

(a) a board having a longitudinal center line and a tail end, a forward end, two longitudinal sides; an upper deck face and a bottom face;

(b) at least one pair of foot control members;

(c) support means for pivotally supporting each foot control member to the board so that each foot control member of each pair is offset from the board's center line and is pivotable about a substantially vertical pivotation axis;

(d) a foot engagement formation for each foot control member above the deck face of the board;

(e) pivotation means provided at the tail end of the board, said pivotation means comprising a vertically rotatable rudder box mounted within said board;

(f) mounting means including a mounting plate for mounting a rudder to said vertically rotatable rudder box;

(g) connection means for operatively connecting each foot control member to the pivotation means for controlling the angular position of the rudder relative to the board by pivotation of any one of the foot control members about its vertical pivotation axis; and (h) a sail mast support for supporting a sail mast extending from the upper deck face.

2. A sailboard as claimed in claim 1, in which each foot engagement formation includes at least one strap adapted for receiving the foot of a person standing on the board.

3. A sailboard as claimed in claim 1, which includes biasing means for biasing the rudder into a neutral position, being in alignment with the longitudinal center line of the board.

* * * * *